US007013692B2

(12) United States Patent
Hegemier

(10) Patent No.: US 7,013,692 B2
(45) Date of Patent: Mar. 21, 2006

(54) VALVE GUIDE GROOVING TOOL

(75) Inventor: Timothy A. Hegemier, Avilla, IN (US)

(73) Assignee: Dana Corporation, Toledo, OH (US)

( * ) Notice: Subject to any disclaimer, the term of this patent is extended or adjusted under 35 U.S.C. 154(b) by 34 days.

(21) Appl. No.: 10/644,439

(22) Filed: Aug. 20, 2003

(65) Prior Publication Data

US 2006/0037376 A1 Feb. 23, 2006

(51) Int. Cl.
*B21D 3/02* (2006.01)

(52) U.S. Cl. ..... 72/118; 72/121; 470/185

(58) Field of Classification Search ..... 72/105, 72/122, 126, 103, 104, 107, 110, 118, 121; 470/185

See application file for complete search history.

(56) References Cited

U.S. PATENT DOCUMENTS

| | | | | | |
|---|---|---|---|---|---|
| 1,414,668 | A | | 5/1922 | Reed | |
| 2,280,686 | A | * | 4/1942 | Colwell | 29/888.4 |
| 2,365,197 | A | * | 12/1944 | Kay | 72/104 |
| RE24,714 | E | | 10/1959 | Bennett et al. | |
| 3,055,240 | A | * | 9/1962 | Patzman et al. | 72/104 |
| 3,473,358 | A | * | 10/1969 | Marcovitch | 72/121 |
| 3,541,826 | A | * | 11/1970 | Halliburton | 72/105 |
| 3,654,793 | A | | 4/1972 | Ziegler, Jr. et al. | |
| 3,700,343 | A | | 10/1972 | Parry | |
| 3,815,397 | A | * | 6/1974 | Hollencamp | 72/121 |
| 4,030,331 | A | | 6/1977 | Keasling | |
| 4,389,867 | A | * | 6/1983 | Whitlock | 72/126 |
| 4,915,069 | A | | 4/1990 | Lafever et al. | |
| 4,942,752 | A | * | 7/1990 | Helfman | 72/70 |
| 5,937,684 | A | * | 8/1999 | Long | 72/118 |
| 6,123,054 | A | | 9/2000 | Netzer | |

* cited by examiner

*Primary Examiner*—Ed Tolan
(74) *Attorney, Agent, or Firm*—Rader, Fishman & Grauer, PLLC

(57) ABSTRACT

A tool for grooving an outer surface of a valve guide comprising a tool body, a tightening nut disposed about a portion of the tool body, one or more rollers rotatably mounted within a bushing, and a handle for rotating the one or more rollers of the tool about the outer surface of the valve guide, wherein the tool is capable of grooving the outer surface of the valve guide while the cylinder head is mounted to an engine. The grooves on the outer surface of the valve guide allow the valve stem seal to grip the valve guide more effectively, thereby improving the retention force on the valve guide. As a result, the movement of the valve stem seal is minimized. A method of using the tool is also described.

10 Claims, 3 Drawing Sheets

VALVE GUIDE GROOVING TOOL

BACKGROUND OF THE INVENTION

1. Field of the Invention

The present invention relates in general to a valve stem seal assemblies, and in particular to a tool for forming grooves in the outer surface of a valve guide to allow the valve stem seal to effectively grip the valve guide, thereby improving the retention force of the valve stem seal on the valve guide.

2. Description of the Related Art

Internal combustion engines have a plurality of intake and exhaust valves, generally in a one-to-one relationship. Each valve comprises a head and an integral stem reciprocally mounted in a valve guide. A valve stem seal is seated over the valve guide and is typically made of a unitary, molded elastomeric material for desired resiliency and temperature resistance, as described in U.S. Pat. No. 6,571,761, the entire contents of which are herein incorporated by reference.

Unfortunately, movement of the valve stem seal from its installed position on the valve guide can eventually result in the valve stem seal being struck by the valve spring retainer and/or keepers, and in turn can result in compromised function of the valve stem seal. Over time, the elastomeric material of the valve stem seal can be destroyed causing excessive oil in the exhaust stream and possibly followed by an engine teardown to verify movement of the valve stem seals.

SUMMARY OF THE INVENTION

The inventor of the present invention has recognized these and other problems associated with the movement of valve stem seals, and has developed a tool for grooving an outer surface of a valve guide comprising a tool body, a tightening nut disposed about a portion of the tool body, at least one roller rotatably mounted to the tool body, and means for rotating the at least one roller about the outer surface of the valve guide, wherein the tool is capable of providing grooves on the outer surface of the valve guide. The grooves on the outer surface of the valve guide allow the valve stem seal to grip the valve guide more effectively, thereby improving the retention force on the valve guide. As a result, the movement of the valve stem seal is minimized.

DESCRIPTION OF THE PREFERRED EMBODIMENT

Figure 2:
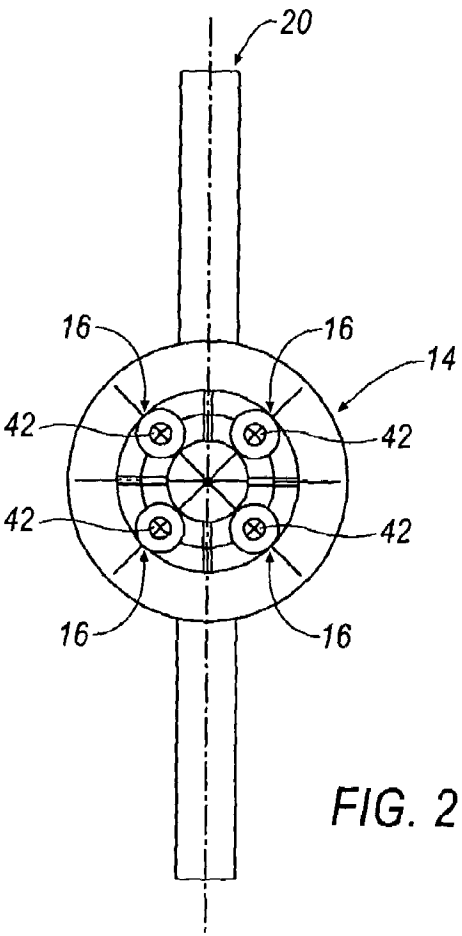
FIG. 2 shows an end view of the grooving tool of FIG. 1 according to the invention.
Figure 1:
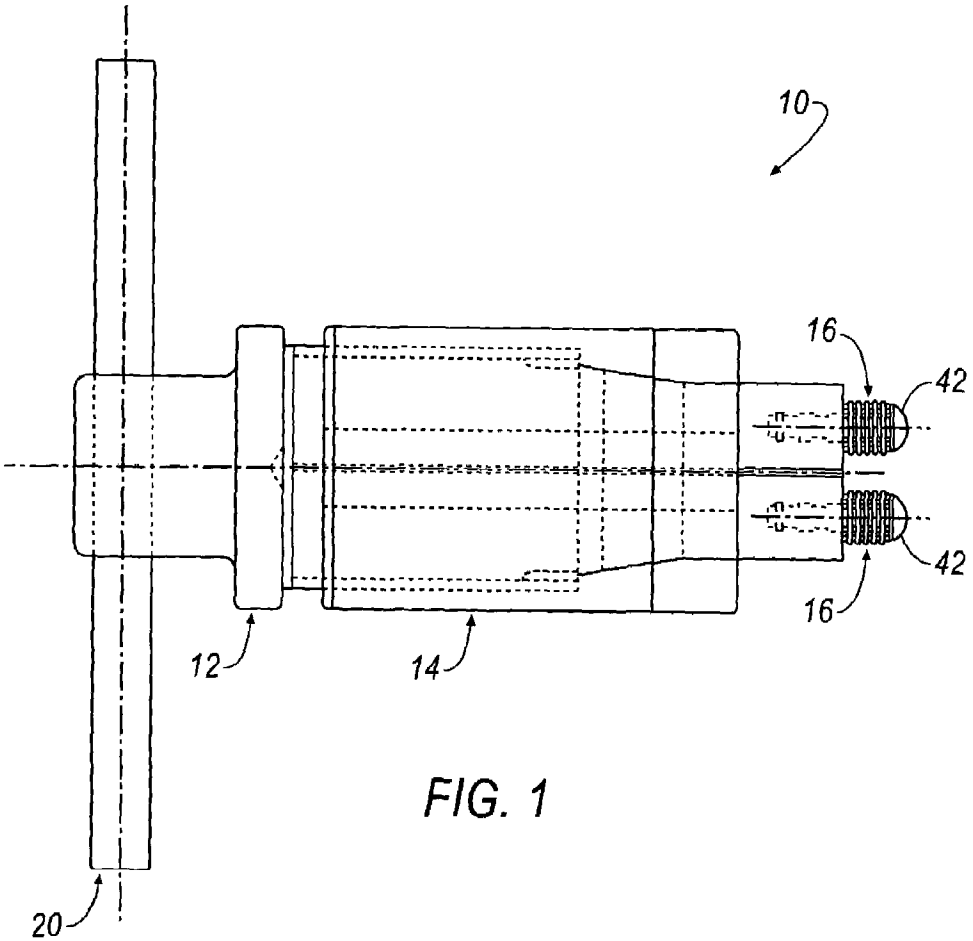
FIG. 1 shows a side elevational view of a grooving tool according to an embodiment of the invention.

Referring now to FIGS. 1 and 2, a grooving tool 10 is shown according to an embodiment of the invention. The grooving tool 10 includes a tool body 12, a tightening nut 14 disposed about a portion of the tool body 12, one or more roller and bushing assemblies 16, and means 20, such as a handle, for rotating the one or more roller and bushing assemblies 16 of the grooving tool 10 about an outer surface of a valve guide (not shown) of a type well-known in the art. The grooving tool 10 is capable of providing grooves in the outer surface of the valve guide while the valve guide is mounted to a cylinder head (not shown) of a type well-known in the art.

Figure 3:
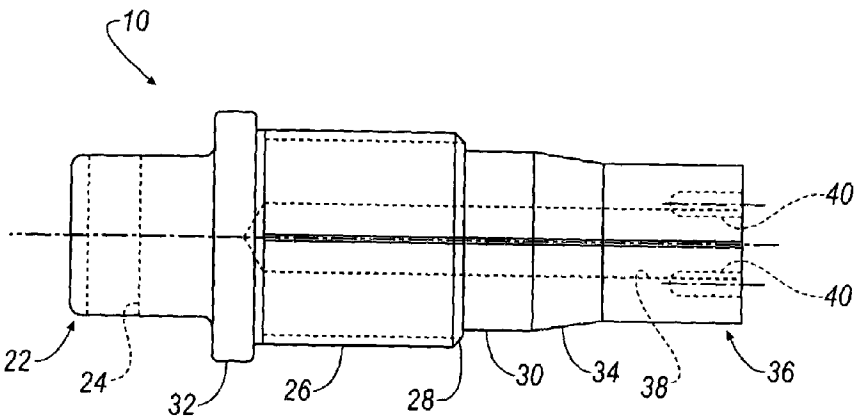
FIG. 3 shows a side elevational view of a tool body of the grooving tool according to the invention.

Referring now to FIG. 3, the tool body 12 is generally cylindrical and includes an end portion 22 having an aperture 24 transversely therethrough for receiving the handle 20. A midsection 26 of the tool body 12 is separated from the end portion 22 by a raised portion 32 that forms a lip between the end portion 22 and the midsection 26. A transition section 28 separates the midsection 26 from a reduced diameter portion 30. A tapered portion 34 is disposed between the reduced diameter portion 30 and a working end portion 36 having a reduced diameter similar to the end portion 22. The reduced diameter of the working end portion 36 allows the grooving tool 10 to be used on cylinder heads with narrow valve spring pockets and various bosses protruding up around the valve guide.

The tool body 12 also includes a relief hole 38 traversing longitudinally through the center of the tool body from the working end portion 36 to the raised portion 32. The relief hole 38 has an inner diameter of sufficient dimensions to allow the grooving tool 10 to be disposed about the valve guide while the cylinder head is mounted on the engine. The working end portion 36 also includes one or more tapped holes 40 capable of receiving a threaded fastener 42 (FIG. 1), such as a screw, or the like. In the illustrated embodiment, four tapped holes 40 are circumferentially disposed approximately ninety (90) degrees apart from each other, as best shown in FIG. 2. Each tapped hole 40 is capable of receiving a threaded fastener 42 for rotatably mounting a corresponding roller and bushing assembly 16. However, the invention can be practiced with any desired number of tapped holes 40 arranged in a desirable circumferential pattern. For example, the invention can be practiced with three tapped holes disposed approximately 120 degrees apart from each other.

Figure 4:
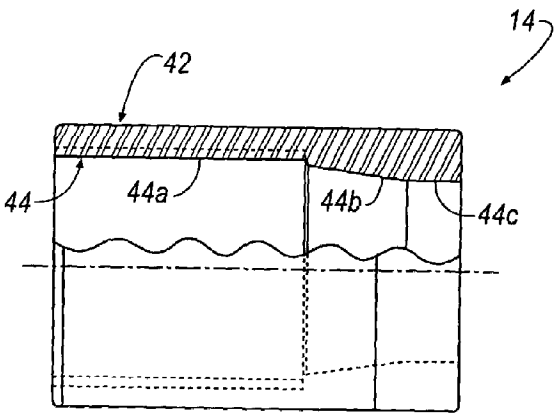
FIG. 4 shows a partial cross sectional view of a tightening nut according to the invention.

Referring now to FIG. 4, the tightening nut 14 is shown according to the invention. The tightening nut 14 is generally cylindrical having an inner diameter substantially corresponding to the outer diameter of the tool body 12 such that the tightening nut 14 is capable of being disposed about a portion of the tool body 12. Specifically, the tightening nut 14 is disposed about the midsection 26, the transition section 28, the reduced diameter portion 30 and the tapered portion 34 of the tool body 12. The tightening nut 14 has an outer surface 42 with a substantially uniform outer diameter. The inner surface 44 of the tightening nut 14 generally corresponds to the profile of the outer surface of the tool body 12. For example, the inner surface 44 of the tightening nut 14 includes a midsection 44*a*, a tapered portion 44*b* and a reduced diameter portion 44*c*. The tightening nut 14 is disposed about the tool body such that rotating the tightening nut 14 in a clockwise direction (when viewed from the end portion 22 of the tool body 12) will cause the tool body 12 to release the pressure on the roller and bushing assemblies 16. The mechanism for releasing and applying pressure to the roller and bushing assemblies 16 is similar to the mechanism used in a drill for tightening and releasing a drill bit. Once pressure is released, the grooving tool 10 can be placed into the valve spring pocket (not shown) such that the valve guide is disposed between the one or more roller and bushing assemblies 16 in preparation of performing a grooving operation, or the grooving tool 10 can be removed from the valve spring pocket once the grooving operation is completed. By rotating of the tightening nut 14 in a counter-clockwise direction, the tool body 12 applies pressure on the one or more roller and bushing assemblies 16 in preparation of performing the grooving operation. The outer surface of the tightening nut 14 may be knurled to provide assistance in gripping the tightening nut 14.

Figure 6:
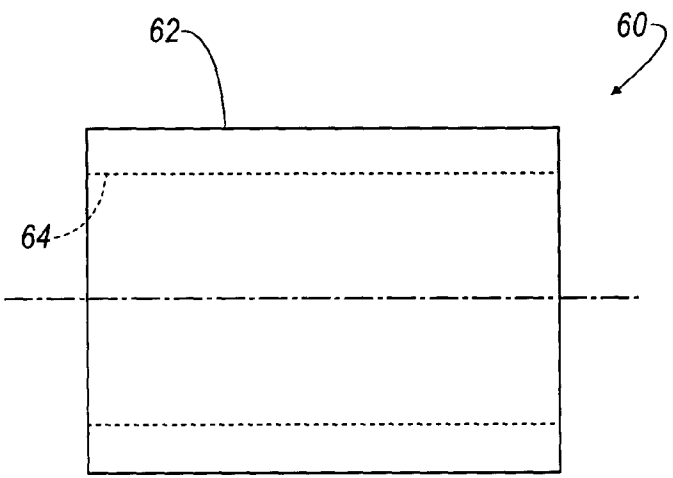
FIG. 6 shows a side elevational view of a bushing according to the invention.
Figure 5:
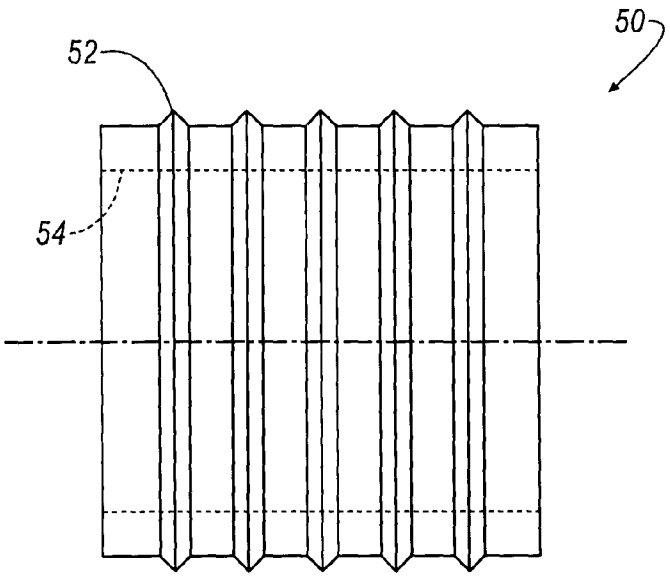
FIG. 5 shows a side elevational view of a roller according to the invention.

Referring now to FIGS. 5 and 6, a roller and bushing assembly 16 is shown according to the invention. The roller and bushing assembly 16 includes a roller, shown generally at 50, and a bushing, shown generally at 60. In the illustrated embodiment, four rollers 50 and associated bushings 60 corresponding to the same number of tapped holes 40 are circumferentially disposed approximately ninety (90) degrees apart from each other, as best shown in FIG. 2. Each roller and bushing assembly 16 is rotatably mounted to the tool body 12 by screwing the threaded fastener 42 into the associated tapped hole 40. It will be appreciated that the roller 50 can be rotatably mounted to the tool body 12 using an alternative means that is well-known to one skilled in the art, and that the invention is not limited by the roller and bushing assembly 16 described above.

As best seen in FIG. 5, the roller 50 is generally cylindrical in shape and includes an outer surface with one or more raised triangular-shaped threads 52 that form cutting edges for forming a corresponding groove when rotated about the valve guide. In the illustrated embodiment, the roller 50 includes five (5) raised threads 52. However, the invention is not limited by the number of threads 52, and that the invention can be practiced with any desirable number of threads 52. For durability, the roller 50 is preferably made of heat-treated steel material having a hardness of between about 48 to 52 Rockwell C.

As best seen in FIG. 6, the bushing 60 is generally cylindrical in shape and has an outer diameter forming an outer surface 62 slightly smaller than an inner diameter 54 of the roller 50 such that the bushing 60 can be disposed within the roller 50. The bushing also includes an inner diameter forming an inner surface 64 of a sufficient dimension to allow the threaded fasteners 42 to be received in the tapped holes 40. The roller and bushing assembly 16 is rotatably mounted to the tool body 12 such that the roller 50 can be rotated while pressure is applied to the valve guide, thereby allowing the roller 50 to form grooves in the outer surface of the valve guide. By providing a plurality of raised threads 52, a corresponding plurality of grooves are formed in the outer surface of the valve guide, thereby reducing the amount of time necessary to form the grooves in the valve guide.

A method of for forming grooves on an outer surface of a valve guide using the grooving tool 10 will now be described. First, the grooving tool 10 is positioned about the valve guide. One aspect of the invention is that the grooving tool 10 can be inserted within a valve spring pocket while the cylinder head is mounted on the engine. Next, the tightening nut 14 is tightened such that at least one roller 50 of the grooving tool 10 engages the outer surface of the valve guide. For example, the tightening nut 14 can be rotated counter-clockwise when looking down on the grooving tool 10 from above. Then, the entire grooving tool 10 is rotated by using the handle 20, preferably at least one full revolution around the valve guide, to form the grooves in the outer surface of the valve guide. Then, the tightening nut 14 is loosened such that the at least one roller no longer engages the outer surface of the valve guide, and the grooving tool 10 is removed from about the valve guide.

While the invention has been specifically described in connection with certain specific embodiments thereof, it is to be understood that this is by way of illustration and not of limitation, and the scope of the appended claims should be construed as broadly as the prior art will permit.

What is claimed is:

1. A tool for grooving an outer surface of a valve guide, comprising:

a tool body, a tightening nut disposed about a portion of the tool body, at least one roller rotatably mounted to the tool body, and means for rotating the at least one roller about the outer surface of the valve guide, and wherein the tool is capable of providing grooves on the outer surface of the valve guide.

2. The tool of claim 1, wherein the tool includes four rollers circumferentially disposed about ninety degrees with respect to each other.

3. The tool of claim 2, further comprising a bushing disposed within each roller to allow each roller to rotate as each roller frictionally engages the outer surface of the valve guide.

4. The tool of claim 1, wherein the tool body includes a tapered portion to allow the tool to be inserted into a valve spring pocket.

5. The tool of claim 1, wherein the at least one roller includes one or more raised threads on its outer surface to form a corresponding number of cutting edges.

6. The tool of claim 1, wherein the at least one roller is made of heat-treated steel material having a hardness of between about 48 to 52 Rockwell C.

7. The tool of claim 1, wherein said rotating means comprises a handle.

8. A method for forming grooves on an outer surface of a valve guide using a grooving tool, the method comprising the steps of:

positioning the grooving tool about a valve guide, tightening a tightening nut disposed about a portion of a tool body of the grooving tool such that at least one roller of the grooving tool engage an outer surface of the valve guide, rotating the grooving tool, loosening the tightening nut such that the at least one roller no longer engages the outer surface of the valve guide, and removing the grooving tool from about the valve guide.

9. The method of claim 8, wherein the grooving tool is inserted into a valve guide pocket while a cylinder head is mounted on an engine.

10. A tool for grooving an outer surface of a valve guide, comprising:

a tool body, a tightening nut disposed about a portion of the tool body, at least one roller rotatably mounted to the tool body, and means for rotating the at least one roller about the outer surface of the valve guide, wherein the tool is capable of providing grooves on the outer surface of the valve guide; and wherein the tool body includes a longitudinally extending relief hole for allowing the tool to be disposed about the valve guide while a cylinder head is mounted to an engine.

* * * * *